US005370977A

United States Patent [19]

Zietlow

[11] Patent Number: 5,370,977

[45] Date of Patent: Dec. 6, 1994

[54] DENTAL X-RAY FILMS

[75] Inventor: Miriam H. Zietlow, Fairport, N.Y.

[73] Assignee: Eastman Kodak Company, Rochester, N.Y.

[21] Appl. No.: 153,701

[22] Filed: Nov. 17, 1993

[51] Int. Cl.[5] ..... G03C 1/46

[52] U.S. Cl. ..... 430/502; 430/567; 430/967

[58] Field of Search ..... 430/502, 567, 139, 967, 430/606

[56] References Cited

U.S. PATENT DOCUMENTS

| | | | |
|---|---|---|---|
| 3,671,254 | 6/1972 | Dostes | 430/502 |
| 3,734,735 | 5/1973 | Bories | 430/502 |
| 4,414,304 | 11/1984 | Dickerson | 430/353 |
| 4,425,425 | 1/1984 | Abbott et al. | 430/502 |
| 4,425,426 | 1/1984 | Abbott et al. | 430/502 |
| 4,439,520 | 3/1984 | Kofron et al. | 430/434 |
| 4,478,929 | 10/1984 | Jones et al. | 430/217 |
| 4,564,588 | 1/1986 | Sakamoto et al. | 430/502 |
| 4,751,174 | 6/1988 | Toya | 430/502 |
| 4,865,944 | 9/1989 | Roberts et al. | 430/495 |
| 5,147,772 | 9/1992 | Tsaur et al. | 430/567 |
| 5,252,442 | 10/1993 | Dickerson et al. | 430/502 |

OTHER PUBLICATIONS

Research Disclosure, Item 18431, Radiographic films/-materials, Section XII, p. 437, Aug. 1979.

*Primary Examiner*—Thomas R. Neville
*Attorney, Agent, or Firm*—Carl O. Thomas

[57] ABSTRACT

Dental X-ray films for the direct absorption of x-radiation are disclosed in which silver halide emulsion layers are coated on the opposite faces a transparent film support. To achieve direct absorption of X-radiation with the low image noise levels required for dental diagnostics while enhancing image invariance as a function of processing solution seasoning silver halide grains containing less than 5 mole percent iodide, based on silver, forming the emulsion layers are coated on each face of the support at a silver coverage of greater than 7.5 $g/m^2$, greater than 75 percent of total grain projected area being accounted for by tabular grains having an average equivalent circular diameter of less than 5.0 $\mu m$, an average thickness of less than 0.36 $\mu m$, and an average aspect ratio of at least 5.

10 Claims, No Drawings

DENTAL X-RAY FILMS

FIELD OF THE INVENTION

The invention relates to silver halide radiographic elements particularly adapted for use in dental diagnostic imaging.

BACKGROUND

In less than one year after the discovery of X-radiation by Roentgen in 1914 silver halide emulsions were being used in radiographic medical diagnostic film. It was recognized almost from the very outset that the high energy ionizing X-radiation was potentially harmful, and ways were sought to avoid high levels of patient exposure.

One approach, still in wide-spread use was to coat the silver halide emulsions on the opposite faces of the film support. It was recognized that a silver halide emulsion layer absorbs only about 1 percent of the X-radiation it receives. By coating a second emulsion layer on the back side of the support X-radiation absorption can be doubled. Dual-coated radiographic films are sold by Eastman Kodak Company under the trademark "Duplitized".

A second approach for X-ray dosage reduction that is compatible with the first approach is to rely on a phosphor containing X-ray intensifying screen to absorb X-radiation and to emit light that exposes the silver halide emulsion of the radiographic element. X-ray intensifying screens are approximately 20 times more efficient in capturing X-radiation than silver halide emulsions. In 1918 the Eastman Kodak Company introduced the first medical radiographic product that was dual coated, and the Patterson Screen Company that same year introduced a matched intensifying screen pair for that product.

As would be expected, indirect radiographic films, those in which an intensifying screen is relied upon to capture X-radiation and to emit light that exposes the film, are fundamentally different in their construction from direct radiographic films, in which imaging depends on the silver halide grains to absorb X-radiation. The primary function of the silver halide grains in indirect radiographic films is to capture light and to produce a viewable silver image. Hence the silver halide coating coverages of dual-coated indirect radiographic films are typically in the range from 1.5 to 3.0 g/m$^2$ of silver per side. About the same overall silver coverage levels are employed in comparable single-sided films (films with silver halide emulsion coatings on only one side of the support).

To at least partially compensate for the much lower X-ray absorption capabilities of silver halide emulsions as compared to intensifying screens direct radiographic films are coated at much higher silver coverages than indirect radiographic films. A typical coating coverage for a dual-coated direct radiographic film is approximately 5 g/m$^2$ of silver per side, with about the same overall silver coverage levels for single-sided direct radiographic films.

In addition to the two broad categories of silver halide radiographic films noted above there is a third category of radiographic film, most commonly employed for dental intra-oral diagnostic imaging and hereafter referred to as dental film. Intra-oral dental imaging has presented practical barriers to the use of intensifying screens. Thus, dental films rely on silver halide grains for absorption of X-radiation. However, the levels of silver coverage typical of general purpose direct radiographic films noted above are inadequate for dental diagnostics. Because of the small size of dental defects sought to be detected, much lower levels of image noise (e.g., granularity) can be tolerated than for general medical diagnostic imaging applications. Thus, for dental films it is not the level of silver that will produce an acceptable maximum image density that controls silver coverages, as in indirect radiographic films, nor is it the level of silver that is capable of directly absorbing X-radiation in an amount sufficient for image generation, as in general purpose direct radiographic films. Dual-coated dental films require still higher silver coverages of greater than 7.5 g/m$^2$ per side to produce silver images of acceptably low noise levels to satisfy the rigorous diagnostic demands of dentistry. The high silver coverages preclude constructing single-sided dental films.

Before 1950 the most commonly employed silver halide emulsions were those prepared by single-jet precipitations. In single-jet precipitations all of the halide salt solution is present in the reaction vessel before silver salt solution is introduced. Thus, precipitation begins with a large stoichiometric excess of halide ions that is continuously reduced as precipitation progresses. An unsought by-product of this precipitation approach is that some tabular grains are produced during the precipitation. No advantage was assigned to the presence of tabular grains, and, in fact, tabular grains all but disappeared from commercial silver halide emulsions when double-jet precipitation, the concurrent addition of silver and halide salt solutions, replaced single-jet precipitation as the emulsion manufacturing procedure of choice.

From 1937 until the 1950's the Eastman Kodak Company sold a dual-coated (Duplitized$^{TM}$) direct radiographic film product under the name No-Screen X-ray Code 5133. Silver coverage was about 5 g/m$^2$ per side. The product represents the highest proportion of tabular grains found in a single-jet emulsion. Tabular grains accounted for greater than 50% of the total grain projected area while nontabular grains accounted for greater than 25% of the total grain projected area. Based on remakes of the emulsion it was concluded that the tabular grains had a mean diameter of 2.5 μm, an average tabular grain thickness of 0.36 μm, and an average aspect ratio of from 5 to 7. The product that superseded Code 5133 to serve the same application was essentially free of tabular grains.

Kofron et al U.S. Pat. No. 4,439,520, filed Nov. 12, 1981, discovered significant photographic advantages for chemically and spectrally sensitized high (>8) aspect ratio tabular grain emulsions. Speed-granularity improvements in both silver and dye-imaging applications were demonstrated. The importance of this discovery was immediately appreciated. Jones et al U.S. Pat. No. 4,478,929 demonstrated that by employing chemically and spectrally sensitized high aspect ratio tabular grain emulsions in dye image transfer systems silver coverages could be reduced from 1.3 g/m$^2$ to 0.4 g/m$^2$ with minimal loss of speed.

Concurrently Abbott et al U.S. Pat. Nos. 4,425,425 and 4,425,426 recognized that the use of chemically and spectrally sensitized high (>8) and intermediate (5-8) aspect ratio tabular grains in dual-coated radiographic elements could be used to reduce crossover, a major source of image unsharpness in dual-coated indirect radiographic films.

Dickerson U.S. Pat. No. 4,414,304 recognized that the use of thin (<0.2 μm) tabular grain emulsions in single-sided or dual-coated indirect radiographic films could be used to reduce silver coverages. The silver coverage of indirect radiographic films is that required to achieve the desired maximum density. It was discovered that thin tabular grain emulsions exhibit increased covering power, defined as 100 times maximum density divided by silver coverage in g/dm$^2$, in fully forehardened emulsions. The art had previously completed hardening during processing after exposure to minimize silver coverages. The practical effect of the discovery is that the practice of delayed hardening has greatly declined.

The discoveries of advantages for tabular grain emulsions has had no impact on dental films. The discoveries of Kofron et al and Abbott et al have no applicability to dental films, since spectral sensitizing dyes are relied upon to capture light while dental films are imagewise exposed only to X-radiation. The discovery of Jones et al relating to dye image transfer systems has no applicability to dental films, since the latter form only silver images. Insofar as the absorption of X-radiation by silver halide grains is concerned, it is immaterial what shape the silver halide grain takes. Absorption is entirely a function of the mass of silver coated, rather than the shape of the individual grains. Further, the granularity of direct X-ray images is a function of the number of grains coated per unit area rather than their shape.

Roberts et al U.S. Pat. No. 4,865,944 combines phosphors and tabular grain emulsions in an integrated intensifying screen and indirect X-ray exposure film intended to serve dental use. Unfortunately, in this construction the phosphors can be used only once. This has rendered this approach to dental imaging cost prohibitive.

Although dental films have continued to employ the emulsions in use prior to the discoveries relating to tabular grain emulsions, dental imaging has continued to experience problems that are peculiar to this application. Whereas silver halide radiographic films are generally processed in highly automated rapid access processors (e.g., Eastman Kodak Company's RP X-Omar TM processor), the small usage of dental film in terms of square meters has precluded the practical adaptation of general rapid access processing to use in dental offices. One of the practical concerns is that processing solutions often become seasoned over extended time and repetition of use, producing different image characteristics with the same film, depending on the stage of seasoning.

SUMMARY OF THE INVENTION

The present invention improves the imaging characteristics of dental films. It preserves the low image noise characteristics of dental films while concurrently reducing image variance as a function of process solution seasoning.

In one aspect this invention is directed to a direct X-ray dental film comprised of a transparent film support and silver halide emulsion layers coated on opposite faces of the support, wherein, for the direct absorption of X-radiation with the low image noise levels required for dental diagnostics, silver halide grains containing less than 5 mole percent iodide, based on silver, forming the emulsion layers are coated on each face of the support at a silver coverage of greater than 7.5 g/m$^2$, greater than 75 percent of total grain projected area being accounted for by tabular grains having an average equivalent circular diameter of less than 5.0 μm, an average thickness of less than 0.3 μm, and an average aspect ratio of at least 5.

DESCRIPTION OF PREFERRED EMBODIMENTS

In a simple form the dental film of this invention can take the following form:

| |
|---|
| High Ag Coating Density Tabular Grain Emulsion A |
| Transparent Film Support |
| High Ag Coating Density Tabular Grain Emulsion B |

The transparent film support can take the form of any convenient conventional radiographic film support known to be useful in dual-coated structures. The film support need not be transparent during imagewise exposure, but must be transparent following processing to allow transmission viewing of radiographic images in both of emulsion layers A and B. Customarily the film retains a blue tint, favored by dentists, after processing.

In the simplest contemplated form emulsion layers A and B can be identical. Each of the emulsion layers contains silver halide grains coated at a high coating coverage to provide greater than 7.5 g/m$^2$ of silver. Thus, the two layers in combination provide a minimum silver coverage of greater than 15 g/m$^2$. As demonstrated by the Examples below these high levels of silver coverage are required to achieve acceptably low levels of granularity compatible with the diagnostic requirements of dental imaging. It is preferred that each emulsion be coated with a silver coverage of at least 8.5 g/m$^2$ with overall silver coverages of both emulsion layers being at least 17 g/m$^2$. Optimally low levels of image granularity are realized when silver coverages in each emulsion layer are at least 10 g/m$^2$ and at least 20 g/m$^2$ overall. It is generally preferred to employ the minimum silver coverages that satisfy the granularity requirements of dental diagnostics, since excess amounts of silver merely serve to increase cost and slow processing. Generally the emulsions of the photographic elements contain no more than 30 g/m$^2$ of silver per side and preferably contain from 8.5 to 25 g/m$^2$ (optimally 10 to 20 g/m$^2$) silver per side.

The objective of requiring high silver coating coverages is to increase the number of imaging centers and hence minimize the random variance (i.e., noise or granularity) in the silver image. It therefore requires only slight reflection to appreciate that not only are high silver coating coverages essential, but also proper selection of the tabular grains. If excessively large and/or thick tabular grains are employed, the low granularity objective cannot be satisfied, even at high silver coverages.

It is therefore contemplated that at least 75 percent of total grain projected area in emulsion layers A and B will be accounted for by tabular grains having an average equivalent circular diameter of less than 5.0 μm, an average thickness of less than 0.3 μm, and an average aspect ratio of at least 5.

In tabular grain emulsions employed for general use in photography and radiography 10 μm is generally accepted as the maximum useful average equivalent circular diameter (ECD) of the grains. For dental films the maximum average ECD of the tabular grains is halved in the interest of reducing granularity. Further, it is preferred that the maximum average ECD of the tabular grains be less than 3.0 μm.

Even with their average ECD's limited as noted above the tabular grain emulsions would still produce unacceptably high levels of granularity absent a restriction on tabular grain volume. Tabular grain volume is limited by requiring that the tabular grains have an average thickness of less than 0.3 μm. Preferably thin tabular grain emulsions having an average tabular grain thickness of less than 0.2 μm. Ultrathin tabular grain emulsions having thicknesses in the range of from <0.07 to 0.03 μm are known. However, granularity requirements can be entirely and are preferably satisfied without resorting to ultrathin tabular grain thicknesses. Preferred tabular grain emulsions are those in which average tabular grain thicknesses are at least 0.1 μm. Thinner tabular grains produce objectionably warm image tones.

The advantages of the dental films of this invention are the result of substituting tabular grain emulsions for the nontabular grain emulsions conventionally employed in dental films. The parameters that differentiate a tabular grain emulsion from a nontabular grain emulsion are (a) the percentage of total grain projected area accounted for by tabular grains and (b) the average aspect ratio and thickness of the tabular grains.

When photographic and radiographic interest in tabular grain emulsions emerged in the early 1980's, a tabular grain emulsion was identified as an emulsion in which tabular grains accounted for greater than 50 percent of total grain projected area. The first tabular grain emulsions contained significant populations of unwanted grains, such as thick tabular grains produced by single twinning, rods, octahedral grains and irregular nontabular grains. In the last decade advances in tabular grain emulsion preparation have markedly reduced the unwanted grain shapes accompanying tabular grains. Accordingly, it is contemplated that greater than 75 percent of total grain projected area will be accounted for by tabular grains satisfying the requirements of the invention. In fact, a wide variety of tabular grain emulsion preparation procedures are available that produce preferred emulsions in which tabular grains account for at least 90 percent of total grain projected area. It has been demonstrated that tabular grains can approach 100 percent of total grain projected area. Tabular grain emulsion preparations have been reported in which tabular grains account for >97% , >99% or 100% (substantially all) of the total grain projected area.

The tabular grains contemplated for use in the dental films of the invention are contemplated to exhibit an average aspect ratio of at least 5. That is, the tabular grains have at least intermediate aspect ratios. Average aspect ratio ($AR_{av}$) is the quotient of average ECD ($ECD_{av}$) divided by average tabular grain thickness ($t_{av}$):

$$AR_{av}=ECD_{av}\div t_{av}. \quad \text{I}$$

High (>8) average aspect ratios ranging up to 50 or more are preferred. Optimum average aspect ratios-are in the range of 10 to 35.

Since tabular grain properties are not dependent merely upon the average aspect ratio of the tabular grains, but also upon the average thickness of the tabular grains, the parameter tabularity (T) has been developed that takes both average aspect ratio and average tabular grain thickness into account:

$$T=ECD_{av}\div t_{av}^2=AR_{av}/t_{av} \quad \text{II}$$

where $ECD_{av}$ and $t_{av}$ are both measured in micrometers (μm). High tabularity (T>25) tabular grain emulsions are preferred. At the preferred minimum $t_{av}$ of 0.1 μm it is apparent that T is 500 when $ECD_{av}$ is 5.0 μm.

Both silver chloride and silver bromide are known to form tabular grain emulsions satisfying the tabular grain requirements set forth above. Both silver chloride and silver bromide can accommodate minor amounts of iodide within the face centered cubic crystal lattice of the grains. It is generally preferred to limit iodide concentrations to less than 5 mole percent, based on total silver, since imaging improvements can be realized at lower iodide concentrations and further increases in iodide slow processing. Silver chloride, silver bromide, silver iodobromide, silver iodochloride, silver bromochloride, silver chlorobromide, silver iodobromochloride, silver bromoiodochloride, silver iodochlorobromide and silver chloroiodobromide tabular grain compositions are all contemplated, where the halides are named in the order of ascending concentrations.

Tabular grain emulsions satisfying the requirements of the invention can be selected from among conventional tabular grain emulsions. The following are representative of high tabularity tabular grain emulsions that can be used to prepare the dental films of the invention:

| | |
|---|---|
| Wilgus et al | U.S. Pat. No. 4,434,226; |
| Kofron et al | U.S. Pat. No. 4,439,520; |
| Wey et al | U.S. Pat. No. 4,414,306; |
| Daubendiek et al | U.S. Pat. No. 4,414,310; |
| Maskasky | U.S. Pat. No. 4,713,320; |
| Maskasky | U.S. Pat. No. 4,713,323; |
| Tsaur et al | U.S. Pat. No. 4,147,771; |
| Tsaur et al | U.S. Pat. No. 4,147,772; |
| Tsaur et al | U.S. Pat. No. 4,147,773; |
| Saitou et al | U.S. Pat. No. 4,797,354; |
| Tsaur et al | U.S. Pat. No. 5,171,659; |
| Maskasky et al | U.S. Pat. No. 5,176,992; |
| Maskasky | U.S. Pat. No. 5,178,997; |
| Maskasky | U.S. Pat. No. 5,178,998; |
| Maskasky | U.S. Pat. No. 5,183,732; |
| Maskasky | U.S. Pat. No. 5,185,239; |
| Tsaur et al | U.S. Pat. No. 5,210,013; |
| Tsaur et al | U.S. Pat. No. 5,221,602; |
| Tsaur et al | U.S. Pat. No. 5,252,453; |
| Brust et al | EPO 0 534 395 A1. |

The tabular grain emulsions employed in the dental films of the invention are chemically sensitized. Noble metal (e.g., gold) and middle chalcogen (i.e., sulfur, selenium and tellurium) chemical sensitizers can be used individually or in combination. Selected site silver salt epitaxial sensitization as taught by Maskasky U.S. Pat. No. 4,435,501 is also contemplated. Conventional chemical sensitizers are disclosed in Research Disclosure, Vol. 308, Dec. 1989, Item 308119, Section III, the disclosure of which is here incorporated by reference. Research Disclosure is published by Kenneth Mason Publications, Ltd., Dudley House, 12 North St., Emsworth, Hampshire P010 7DQ, England.

Other conventional features of preferred emulsion layers of the dental films of the invention are disclosed both in Item 308119, which is directed to silver halide emulsion technology generally, and in Research Disclosure, Vol. 184, August 1979, Item 18431, the disclosure of which is directed specifically to radiographic elements. The emulsion grains can be internally doped as disclosed in Item 308119, Section I, sub-section D, and Item 18431, Section I, subsection C. The emulsions can contain antifoggants and stabilizers, as disclosed in Item 308119, Section VI, and Item 18431, Section II. A general description of vehicles and vehicle extenders and hardeners for the emulsions other processing solution penetrable layers of the radiographic elements are disclosed by Item 308119, Sections IX and X.

Since the dental films are intended to be exposed by the direct absorption of X-radiation, spectral sensitization of the emulsions serves no useful purpose. However, to avoid fogging the film with inadvertent light exposure it is specifically contemplated to incorporate a "desensitizer" in the emulsions. The term "desensitizer" is employed in its ordinary photographic usage to indicate a material that reduces the sensitivity of an emulsion to light exposures. Conventional desensitizers employed in photography and, occasionally, in indirect radiography do not reduce the absorption of X-radiation and hence do not reduce the sensitivity of the emulsions to X-radiation exposures. Conventional desensitizers that are not dyes are disclosed in Research Disclosure, Item 308119, Section IV, sub-section B. Dyes that spectrally sensitize surface fogged direct positive emulsions by trapping surface electrons are also recognized to desensitize surface latent image forming emulsions, such as those contemplated for use in the practice of this invention. Desensitizers of this class are disclosed in Item 308119, Section IV, sub-section A, paragraphs G and J.

The radiographic elements of this invention preferably contain additional conventional features, such as protective layers overlying the emulsion layer and undercoat layers coated between the support and the emulsion layer. Research Disclosure, Item 18431, discloses in Section III antistatic agents and layers and in Section IV overcoat layers. While neither antihalation layers nor crossover reduction layers serve any useful function in the dental films of the invention, the remaining features of conventional overcoats and subbing layers of general purpose direct and indirect radiographic elements disclosed in the patents below and here incorporated by reference are applicable to the dental films of this invention:

| | |
|---|---|
| Abbott et al | U.S. Pat. No. 4,425,425; |
| Abbott et al | U.S. Pat. No. 4,425,426; |
| Dickerson et al | U.S. Pat. No. 4,414,304; |
| Kelly et al | U.S. Pat. No. 4,803,150; |
| Kelly et al | U.S. Pat. No. 4,900,652; |
| Dickerson et al | U.S. Pat. No. 4,994,355; |
| Bunch et al | U.S. Pat. No. 5,021,327; |
| Childers et al | U.S. Pat. No. 5,041,364; |
| Dickerson et al | U.S. Pat. No. 5,108,881; |
| Dickerson | U.S. Pat. No. 5,252,443. |

Dental films can be processed using the same processing solutions employed for general purpose direct and indirect radiographic element processing. The differences in dental film processing stem from the differences between medical and dental practices in producing X-ray diagnostic images. Medical doctors largely refer their patients to radiological facilities that are continuously engaged in X-ray imaging during the course of the business day. Medical X-ray processing is generally measured in seconds, with total processing occurring in less than 60 seconds. On the other hand, dentists expose and process dental film in their offices as the need arises. The much higher silver coverages in dental films requires processing to be conducted over a-period of minutes, rather being measured in seconds, as in general purpose radiographic element processing. Also individual dental film elements, commonly referred to as "chips", are much smaller in area that a single unit of medical X-ray film. Hence, the equipment that has been developed for medical diagnostic images is too large and expensive to be practically employed in dental offices. While processing equipment particularly adapted for dental use is commercially available, hand processing of dental film also occurs. In its simplest form dental film processing requires only a developing agent, a fixing agent and tap water.

EXAMPLES

In the examples coating coverages in parenthesis are in units of mg/ft$^2$ while the coating coverages brackets are in units of g/m$^2$. The tabular grain projected area in each of the tabular grain emulsions is greater than 75 percent of total grain projected area.

EXAMPLES 1-6

A dental film typical of those in current use, Film 1C, and a series of dental films containing tabular grain emulsions at varied silver coverages were selected for comparison. All of the films were coated onto 180 μm (7 mil) blue tinted poly(ethylene terephthalate) film support.

Film 1C

Emulsion Layer: A nontabular (t=ECD) grain AgBrI emulsion with an average grain ECD of 1.4 μm and a grain iodide content of 1.7 M %, based on silver, was sensitized and provided with conventional addenda as follows: silver [10.2] (950), gelatin [6.76](628), potassium chloroaurate [$1.5\times10^{-4}$](0.014), desensitizing dye DS-1, 3'-ethyl-3-methyl-6-nitro-thiathiazolinocyanine iodide [$3.7\times10^{-3}$](0.341), potassium bromide [$5.4\times10^{-3}$](5.01), sorbitol [0.58](53.84), 5-methyl-s-triazole-(2,3-a)pyrimidine-7-ol, sodium salt [0.24](22.76), 4-phenylurazole [$8.3\times10^{-3}$](0.774), 3,5-disulfocatechol disodium salt [0.25](23.10), nitron [$7.4\times10^{-3}$](0.688), bis(2-amino-5-iodopyridine dihydroiodide) mercuric iodide [$1.7\times10^{-4}$](0.016), sulfuric acid [$3.4\times10^{-2}$](3.118), and bis(vinylsulfonyl) methane hardener [$6.0\times10^{-2}$](5.53). Protective Overcoat, SOC-1: gelatin [0.89](82.5), poly(methylmethacrylate) matte [$5.1\times10^{-2}$](4.7), ammonium tetrachloropalladate II [$2.4\times10^{-3}$](0.221), saponin [$4.1\times10^{-2}$](3.8), and the octylphenylethylene oxide surfactant Triton X 200E TM commercially available from Rohm and Haas [$1.4\times10^{-2}$](1.34).

Film 2C

Emulsion Layer: A tabular grain AgBr emulsion with an average grain ECD of 3.7 μm and t of 0.14 μm was sensitized and provided with conventional addenda as follows: silver [4.6](425), gelatin [4.6](425), potassium chloroaurate [$6.5\times10^{-5}$](0.006), desensitizing dye DS-1 [$1.6\times10^{-3}$](0.153), potassium bromide [$5.4\times10^{-3}$](5.01), sorbitol [0.26](24.09), 5-methyl-s-triazole-(2,3-a)pyrimidine-7-ol, sodium salt [0.26](24.09), 4-phenylurazole [$3.7\times10^{-3}$](0.308), 3,5-disulfocatechol disodium salt [0.11](10.33), nitron [$3.3\times10^{-3}$](0.308), sulfuric acid [$1.5\times10^{-2}$](1.395), and bis(vinylsulfonyl)methane hardener [$5.4\times10^{-2}$](5.08). Protective Overcoat, SOC-2: gelatin [0.89](82.5), poly(methylmethacrylate) matte [$5.1\times10^{-2}$](4.7), the sodium dodecylsulfate surfactant Dupanol ME TM commercially available from Dupont [$8.6\times10^{-4}$](0.08), the nonylphenyl-2-hydroxypropylene oxide surfactant Olin 10G TM commercially available from Olin [$4.5\times10^{-2}$](4.14), and the trimethyl-3-(perfluorooctylsulfonamidopropyl)ammonium iodide surfactant Fluorad FC-135 TM commercially available from 3M [$1.1\times10^{-3}$](0.10).

Film 3E

Emulsion Layer: A tabular grain AgBr emulsion with an average grain ECD of 2.6 μm and t of 0.13 μm was sensitized and provided with conventional addenda as follows: silver [7.7](715), gelatin [5.8](536), potassium chloroaurate [$1.1\times10^{-4}$](0.010), desensitizing dye DS-1 [$2.7\times10^{-3}$](0.257), potassium bromide [$4.1\times10^{-2}$](3.77), sorbitol [0.44](40.52), 5-methyl-s-triazole-(2,3-a)pyrimidine-7-ol, sodium salt 0.15](17.38), 4-phenylurazole [$6.3\times10^{-3}$](0.582), 3,5-disulfocatechol disodium salt [0.18](17.38), nitron [$5.6\times10^{-3}$](0.518), sulfuric acid [$2.5\times10^{-2}$](2.347), and bis(vinylsulfonyl)methane hardener [$6.7\times10^{-2}$](6.19).

Protective Overcoat, SOC-2.

Film 4E

Emulsion Layer: A tabular grain AgBrI emulsion with an average grain ECD of 2.0 μm, t of 0.13 μm and iodide content of 3.0 M %, based on silver, was sensitized and provided with conventional addenda as follows: silver [9.1](850), gelatin [6.9](638), potassium chloroaurate [$1.3\times10^{-4}$](0.012), desensitizing dye DS-1 [$3.3\times10^{-3}$](0.305), potassium bromide [$4.8\times10^{-2}$](4.48), sorbitol [0.52](48.17), 5-methyl-s-triazole-(2,3-a)pyrimidine-7-ol, sodium salt [0.18](16.59), 4-phenylurazole [$7.4\times10^{-3}$](0,692), 3,5-disulfocatechol disodium salt [0.22](20.67), nitron [$6.6\times10^{-3}$](0.616), sulfuric acid [$3.0\times10^{-2}$](2.790), and bis(vinylsulfonyl)methane hardener [$7.6\times10^{-2}$](7.21).

Protective Overcoat, SOC-2.

Film 5E

Emulsion Layer: A tabular grain AgBr emulsion with an average grain ECD of 1.8 μm and t of 0.13 μm was sensitized and provided with conventional addenda as follows: silver [12.4](1150), gelatin [9.3](863), dextran [3.1](288), potassium chloroaurate [$1.8\times10^{-4}$](0.017), desensitizing dye DS-1 [$4.4\times10^{-3}$](0.413), potassium bromide [$6.5\times10^{-2}$](6.06), sorbitol [0.70](65.18), 5-methyl-s-triazole- (2,3-a)-pyrimidine-7-ol, sodium salt [0.24](22.45), 4-phenylurazole [$1.0\times10^{-2}$](0.937) , 3,5-disulfocatechol disodium salt [0.30](27.96 ), nitron [$5.7\times10^{-3}$](0.833), sulfuric acid [$4.6\times10^{-2}$](3.774), and bis(vinylsulfonyl)methane hardener [0.1](9.46).

Protective Overcoat, SOC-2.

Film 6E

Emulsion Layer: A tabular grain AgBr emulsion with an average grain ECD of 1.4 μm and t of 0.13 μm was sensitized and provided with conventional addenda as follows: silver [21.5](2000), gelatin [21.5](1000), dextran [5.4](500), potassium chloroaurate [$3.1\times10^{-4}$](0.029), desensitizing dye DS-1 [$7.7\times10^{-3}$](0.719), potassium bromide [0.11](10.54), sorbitol [1.22](113.35), 5-methyl-s-triazole-(2,3-a)pyrimidine-7-ol, sodium salt [0.42](39.04), 4-phenylurazole [$1.8\times10^{-2}$](1.629), 3,5-disulfocatechol disodium salt [0.52](48.63), nitron [$1.6\times10^{-2}$](1.449), sulfuric acid [$7.1\times10^{-2}$](6.564), and bis (vinylsulfonyl)methane hardener [0.12](10.83). Protective Overcoat, SOC-2.

Exposure and Processing

The films were identically exposed to X-radiation through a stepped density test object and processed through an Air Techniques AT-2000 TM dental processor set at 28° C. and a 5.5 minute processing cycle time containing dental Developer A and Fixer A. Exposed samples of each film were processed at three different stages of processing solution seasoning: (1) when the processing chemistry was newly added, hereinafter designated FRESH: (2) after the equivalent of 280 dental chips had passed through the processor, thereby representing an intermediate level of seasoning, hereinafter designated SEA-280; and (3) after the equivalent of 560 dental chips had been passed through the processor, thereby representing a near terminal utility level of seasoning, hereinafter designated SEA-560.

| Ingredients | | Amt. in Grams |
|---|---|---|
| **Developer A** | | |
| Water | | 900.0 |
| Hydroquinone | | 25.0 |
| 4-Hydroxymethyl-4-methyl-1-phenyl-3-pyrazolidinone | | 1.21 |
| Sodium meta-bisulfite | | 77.1 |
| Sodium hydroxide, 50% by wt. soln. | | 89.9 |
| Sodium bromide | | 2.4 |
| Sodium bicarbonate | | 18.0 |
| Pentetic acid, pentasodium salt, 50% by wt. soln. | | 7.7 |
| 5-Methylbenzotriazole | | 0.036 |
| Total Weight | | 1121.35 |
| **Fixer A** | | |
| Water | | 769.0 |
| Glacial Acetic Acid | | 20.0 |
| Sodium hydroxide, 50% by wt. soln. | | 4.27 |
| Tartaric acid | | 1.50 |
| Solution 4242 | | 271.0 |
| Ammonium thiosulfate | 56.6% by wt. | |
| Ammonium sulfite | 4.0% by wt. | |
| Water | 39.0% by wt. | |
| Sodium tetraborate, pentahydrate | | 4.4 |
| Sodium meta-bisulfite | | 3.43 |
| Aluminum sulfate, 25% by wt. soln. | | 20.0 |
| Total Weight | | 1093.60 |

Sensitometric Properties

The exposed and processed dental chips were examined for speed, contrast and granularity. Speed was measured at a density of 0.85 above minimum density and is reported below as relative log speed units. Contrast was measured as the average gradient between densities of 0.25 and 2.0. Granularity was measured objectively as Selwyn Granularity using a scanning aperture of 48 μm. Granularity ratings ranging from Poor and Unacceptable to Excellent were also assigned based on visual rankings assigned by an expert viewer.

The sensitometric observations are summarized in Table I below.

TABLE I

| Film | Silver g/m²/side | Granularity Objective/ Expert Rating | Condition | Speed | Contrast | Range Δ Speed | Range Δ Contrast |
|---|---|---|---|---|---|---|---|
| 1C | 10.2 | 0.528 | FRESH | 265 | 1.76 | | |
| | | GOOD | SEA-280 | 263 | 1.51 | | |
| | | | SEA-560 | 264 | 1.42 | 2 | 0.34 |
| 2C | 4.6 | 0.937 | FRESH | 269 | 1.71 | | |
| | | POOR AND | SEA-280 | 279 | 1.59 | | |
| | | UNACCEPTABLE | SEA-560 | 284 | 1.52 | 5 | 0.19 |
| 3E | 7.7 | 0.577 | FRESH | 267 | 1.9 | | |
| | | ACCEPTABLE | SEA-280 | 269 | 1.82 | | |
| | | | SEA-560 | 266 | 1.75 | 3 | 0.15 |
| 4E | 9.1 | 0.541 | FRESH | 269 | 1.85 | | |
| | | GOOD | SEA-280 | 270 | 1.77 | | |
| | | | SEA-560 | 268 | 1.72 | 2 | 0.15 |
| 5E | 12.4 | 0.436 | FRESH | 257 | 1.85 | | |
| | | VERY GOOD | SEA-280 | 257 | 1.79 | | |
| | | | SEA-560 | 255 | 1.76 | 2 | 0.09 |
| 6E | 21.5 | 0.156 | FRESH | 263 | 1.87 | | |
| | | EXCELLENT | SEA-280 | 259 | 1.83 | | |
| | | | SEA-560 | 258 | 1.73 | 5 | 0.14 |

From Table I the deficiency of currently available commercial dental films can be seen by observing the performance of comparative Film 1C. Using nontabular grain emulsions and high silver coating densities (10.2 g/m²) granularity is generally ranked as good; however, the film demonstrates a large shift in image contrast of 0.34 with progressive seasoning of the processing solution.

Comparative Film 2C differs from Film 1C in substituting for the nontabular grain emulsion a tabular grain emulsion at a coating coverage representative of those at which tabular grain emulsions have heretofore been employed for direct imaging. While contrast variance as a function of process solution seasoning is reduced from 0.34 to 0.19, speed variance is more than doubled. Poor and unacceptable levels of image granularity are observed.

Example Film 3E differs from Film 2C by increasing the silver coating coverage per side to >9.5 g/m². At this increased level of silver coverage, a further significant reduction in contrast variance as a function of process solution seasoning is observed. More importantly, an acceptable level of granularity is observed.

Example Films 4E, 5E and 6E demonstrate the further increases in silver coverage improve image quality from acceptable to excellent with the significant reductions in contrast variance as a function of processing solution seasoning being retained.

The Example films demonstrate that the low levels of image noise required for dental diagnostic imaging can be met and improved upon through the use of tabular grain emulsions at high coating densities. Further, a quite unexpected and significant stabilization of image contrast as a function processing solution seasoning also can be achieved.

The invention has been described in detail with particular reference to preferred embodiments thereof, but it will be understood that variations and modifications can be effected within the spirit and scope of the invention.

What is claimed is:

1. A direct X-ray dental film comprised of
a transparent film support and
silver halide emulsion layers, said emulsion layers consisting of two emulsion layers coated on opposite faces of the support for the direct absorption of X-radiation with the low image noise levels required for dental diagnostics, each of said emulsion layers being comprised of chemically sensitized silver halide grains containing less than 5 mole percent iodide, based on silver, each of said emulsion layers being coated on the support at a silver coverage of greater than 7.5 g/m², and greater than 75 percent of the total projected area of said silver halide grains being accounted for by tabular grains having an average equivalent circular diameter of less than 5.0 μm, an average thickness of less than 0.3 μm, and an average aspect ratio of at least 5.

2. A direct X-ray dental film according to claim 1 wherein the emulsion layers are coated on each face of the support at a silver coverage of from 8.5 to 15 g/m².

3. A direct X-ray dental film according to claim 2 wherein the emulsion layers are coated on each face of the support at a silver coverage of from 10 to 20 g/m².

4. A direct X-ray dental film according to claim 1 wherein the tabular grains have an average equivalent circular diameter of less than 3.0 μm.

5. A direct X-ray dental film according to claim 1 wherein the tabular grains have an average aspect ratio of greater than 8.

6. A direct X-ray dental film according to claim 1 wherein the tabular grains have an average thickness of at least 0.1 μm.

7. A direct X-ray dental film according to claim 1 wherein the emulsion layers contain silver bromide tabular grains.

8. A direct X-ray dental film according to claim 1 wherein the emulsion layers contain silver iodobromide tabular grains.

9. A direct X-ray dental film according to claim 1 wherein the emulsion layers contain a desensitizer to reduce the sensitivity of the emulsion layers to light.

10. A direct X-ray dental film comprised of
a blue tinted transparent film support and
silver halide emulsion layers, said emulsion layers consisting of two emulsion layers coated on opposite faces of the support for the direct absorption of X-radiation with the low image noise levels required for dental diagnostics, each of said emulsion layers being comprised of (a) chemically sensitized silver halide grains chosen from silver bromide and silver iodobromide grains containing less than 5 mole percent iodide, based on silver, and (b) a desensitizer to reduce the sensitivity of the emulsions to light, each of said emulsion layers being coated on each face of the support at a silver coverage of from 8.5 to 25 g/m$^2$, and greater than 75 percent of the total projected area of said silver halide grains being accounted for by tabular grains having an average equivalent circular diameter of less than 3.0 μm, an average thickness of less than 0.2 μm, and an average aspect ratio of greater than 8.

* * * * *